US005911129A

United States Patent [19]

Towell

[11] Patent Number: 5,911,129

[45] Date of Patent: Jun. 8, 1999

[54] AUDIO FONT USED FOR CAPTURE AND RENDERING

[75] Inventor: Timothy N. Towell, Beaverton, Oreg.

[73] Assignee: Intel Corporation, Santa Clara, Calif.

[21] Appl. No.: 08/764,962

[22] Filed: Dec. 13, 1996

[51] Int. Cl.[6] ..... G10L 3/00

[52] U.S. Cl. ..... 704/272; 704/278; 704/270

[58] Field of Search ..... 704/272, 246, 704/278, 501, 502

[56] References Cited

U.S. PATENT DOCUMENTS

| | | | |
|---|---|---|---|
| 4,935,956 | 6/1990 | Hellearth | 379/112 |
| 4,945,557 | 7/1990 | Kaneuchi | 379/88 |
| 5,327,521 | 7/1994 | Savic et al. | 704/272 |
| 5,465,290 | 11/1995 | Hampton | 704/246 |
| 5,563,649 | 10/1996 | Gould et al. | 348/17 |
| 5,594,784 | 1/1997 | Velius | 379/88 |
| 5,641,926 | 6/1997 | Gibson | 704/207 |

OTHER PUBLICATIONS

Steve Smith, "Dual Joy Stick Speaking Word Processor and Musical Instrument," Proceedings: John Hopkins National Search for Computing Applications to Assist Persons with Disabilities, Feb. 1–5, 1992, p. 177.

B. Abner & T. Cleaver, "Speech Synthesis Using Frequency Modulation Techniques," Proceedings: IEEE Southeastcon '87, Apr. 5–8, 1987, vol. 1 of 2, pp. 282–285.

Alex Waibel, "Prosodic Knowledge Sources for Word Hypothesization in a Continuous Speech Recognition System," IEEE, 1987, pp. 534–537.

Alex Waibel, "Research Notes in Artificial Intelligence, Prosody and Speech Recognition," 1988, pp. 1–213.

Victor W. Zue, "The Use of Speech Knowledge in Automatic Speech Recognition," IEEE, 1985, pp. 200–213.

*Primary Examiner*—David R. Hudspeth
*Assistant Examiner*—Daniel Abebe
*Attorney, Agent, or Firm*—Kenyon & Kenyon

[57] ABSTRACT

An analog voice signal is encoded for playback in a form in which the identity of the speaker's voice is disguised. To do this, the analog voice signal is converted to a first digital voice signal which is divided into a plurality of sequential speech segments. A plurality of voice fonts, for different types of voices are stored and one of these is selected as a playback voice font. An encoded voice signal for playback which includes the plurality of sequential speech segments and either the selected font or an identification of the selected font is generated. In addition, the digital voice signal is analyzed to identify characteristics of the voice signal.

15 Claims, 2 Drawing Sheets

AUDIO FONT USED FOR CAPTURE AND RENDERING

CROSS REFERENCE TO RELATED APPLICATIONS

The subject matter of the present application is related to the subject matter of U.S. patent application attorney docket number 2207/4032 entitled "Retaining Prosody During Speech Analysis For Later Playback," and attorney docket number 2207/4031 entitled "Representing Speech Using MIDI," both to Dale Boss, Sridhar Iyengar and T. Don Dennis and assigned to Intel Corporation, filed on even date herewith, the disclosure of which, in it entirity is hereby incorporated by reference.

BACKGROUND OF THE INVENTION

The present invention relates to audio processing in general and more particularly to a method and apparatus for modifying the sound of a human voice.

There are several methods of modifying the perception of the human voice. One of the most common is performed in television and radio programs where an interviewees voice is disguised so as to conceal the identity of the interviewee. Such voice modification is typically done with a static filter that acts upon the analog voice signal that is input to a microphone or similar input device. The filter modifies the voice by adding noise, increasing pitch, etc. Another method of modifying one's voice (specifically over a telephone) is to use a similar filter as described above or a more primitive manner would be to use a handkerchief or plastic wrap covering the mouthpiece of the phone.

Applications, such as the Internet, are increasingly using voice for communication (separate from or in addition to text and other media). Normally this is done by digitizing the signal generated by the originator speaking into a microphone and then formatting that digitized signal for transmission over the Internet. At the receiving end, the digital signal is converted back to an analog signal and played through a speaker. Within limits, the voice played at the receiving end sounds like the voice of the speaker. However, in many instances there is a desire that the speaker's voice be disguised. On the other hand, the listener, even if not hearing the speaker's natural voice, wants to know the general characteristics of the person to whom he is talking. To disguise one's voice in an Internet application or the like, a static filter such as the one described above can be used. However, such modification usually results in a voice that sounds unhuman. Furthermore, it gives the listener no information concerning the person to whom he is listening.

Various systems for analyzing and generating speech have been developed. In terms of speech analysis, automatic speech recognition systems are known. These can include an analog-to-digital (A/D) converter for digitizing the analog speech signal, a speech analyzer and a language analyzer. Initially, the system stores a dictionary including a pattern (i.e., digitized waveform) and textual representation for each of a plurality of speech segments (i.e., vocabulary). These speech segments may include words, syllables, diphones, etc. The speech analyzer divides the speech into a plurality of segments, and compares the patterns of each input segment to the segment patterns in the known vocabulary using pattern recognition or pattern matching in attempt to identify each segment.

The language analyzer uses a language model, which is a set of principles describing language use, to construct a textual representation of the analog speech signal. In other words, the speech recognition system uses a combination of pattern recognition and sophisticated guessing based on some linguistic and contextual knowledge. For example, certain word sequences are much more likely to occur than others. The language analyzer may work with the speech analyzer to identify words or resolve ambiguities between different words or word spellings. However, due to a limited vocabulary and other system limitations, a speech recognition system can guess incorrectly. For example, a speech recognition system receiving a speech signal having an unfamiliar accent or unfamiliar words may incorrectly guess several words, resulting in a textual output which can be unintelligible.

One proposed speech recognition system is disclosed in Alex Waibel, "Prosody and Speech Recognition, Research Notes In Artificial Intelligence," Morgan Kaufman Publishers, 1988 (ISBN 0-934613-70-2). Waibel discloses a speech-to-text system (such as an automatic dictation machine) that extracts prosodic information or parameters from the speech signal to improve the accuracy of text generation. Prosodic parameters associated with each speech segment may include, for example, the pitch (fundamental frequency $F_0$) of the segment, duration of the segment, and amplitude (or stress or volume) of the segment. Waibel's speech recognition system is limited to the generation of an accurate textual representation of the speech signal. After generating the textual representation of the speech signal, any prosodic information that was extracted from the speech signal is discarded. Therefore, a person or system receiving the textual representation output by a speech-to-text system will know what was said, but will not know how it was said (i.e., pitch, duration, rhythm, intonation, stress).

Speech synthesis systems also exist for converting text to synthesized speech, and can include, for example, a language synthesizer, a speech synthesizer and a digital-to-analog (I/A) converter. Speech synthesizers use a plurality of stored speech segments and their associated representation (i.e., vocabulary) to generate speech by, for example, concatenating the stored speech segments. However, because no information is provided with the text as to how the speech should be generated (i.e., pitch, duration, rhythm, intonation, stress), the result is typically an unnatural or robot sounding speech. As a result, automatic speech recognition (speech-to-text) systems and speech synthesis (text-to-speech) systems may not be effectively used for the encoding, storing and transmission of natural sounding speech signals. Moreover, the areas of speech recognition and speech synthesis are separate disciplines. Speech recognition systems and speech synthesis systems are not typically used together to provide for a complete system that includes both encoding an analog signal into a digital representation and then decoding the digital representation to reconstruct the speech signal. Rather, speech recognition systems and speech synthesis are employed independently of one another, and therefore, do not typically share the same vocabulary and language model.

Accordingly, there is a need for a method and apparatus that allows for the modification of voice that results in a natural sounding output that conceals the identity of the person speaking. There is also a need for a method and apparatus that allows for detection of user-specific and non user-specific qualities of the person speaking.

SUMMARY OF THE INVENTION

This need is fulfilled by embodiments of the present invention which include a method of and apparatus for encoding an analog voice signal for playback in a form in which the identity of the voice is disguised. The analog voice signal is converted to a first digital voice signal which is divided into a plurality of sequential speech segments. A plurality of voice fonts, for different types of voices, are stored in a memory. One of these is selected as a playback voice font. An encoded voice signal for playback is generated and includes the plurality of sequential speech segments and either the selected font or an identification of the selected font.

DETAILED DESCRIPTION

Figure 1:
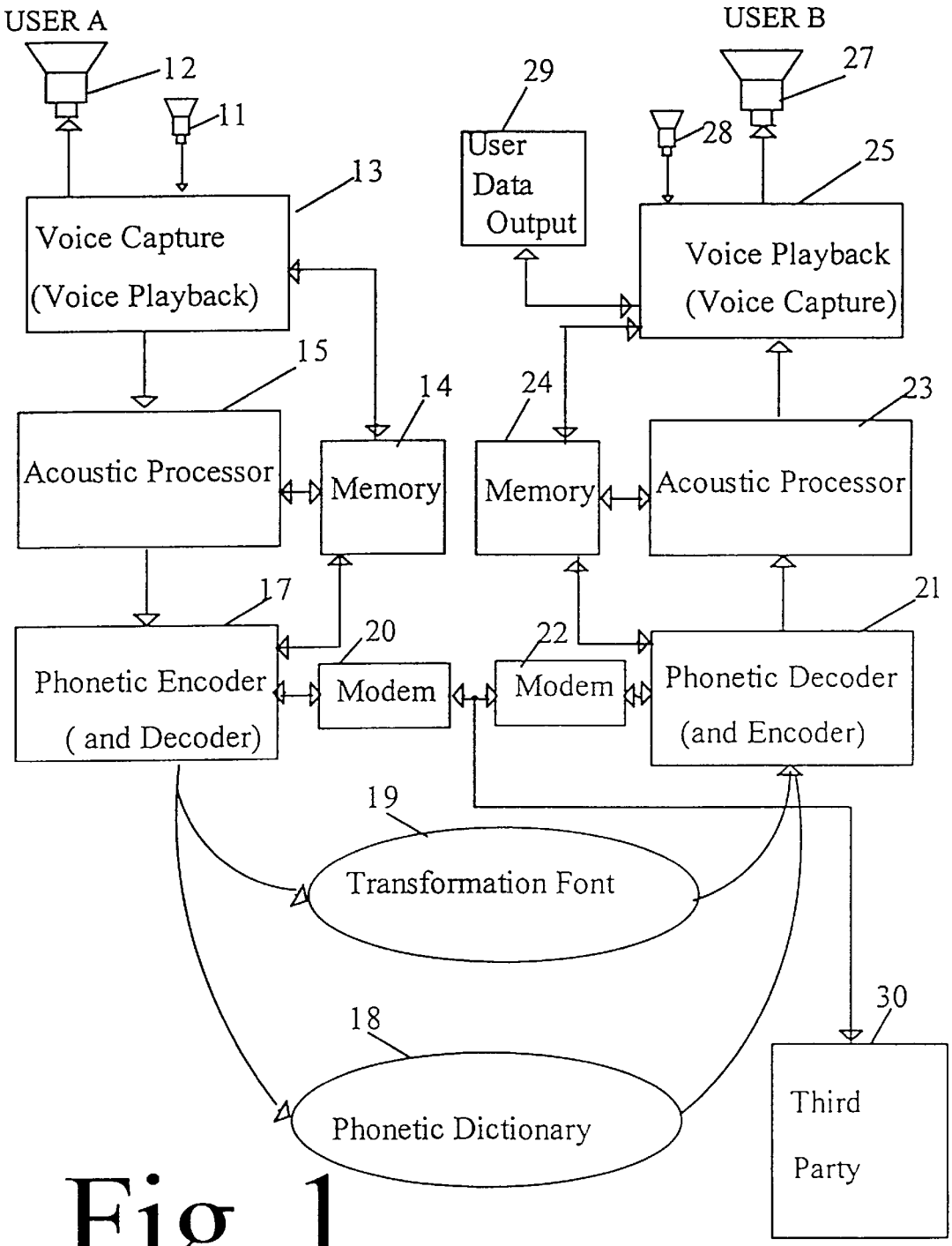
FIG. 1 is a block diagram of an embodiment of a system for identifying and modifying a person's voice constructed according to the present invention.

FIG. 1 is a functional block diagram of an embodiment according to the present invention. In this example, User A and User B at different locations are in communication with one another in a personal computer environment. User A speaks into a microphone 11 which converts this sound input into an analog input signal which, in turn, is supplied to a voice capture circuit 13. The voice capture circuit 13 samples the analog input signal from the microphone at a rate of 40 kHz, for example, and outputs a digital value representative of each sample of the analog input signal. (Ideally, this value should be close to the Nyquist rate for the highest frequency obtainable for human voice.) In other the words, the voice capture circuit provides an analog-to-digital (A/D) conversion of the analog voice input signal. As indicated unit 13 can also provide voice playback, i.e., digital-to-analog conversion of output digital signals that can be conveyed to an analog output device such as a speaker 12 or other sound reproducing device. There are a number of commercially available sound cards that perform this function, such as a SoundBlaster® sound card designed and manufacture by Creative Laboratories, Inc. (San Jose, Calif.). Such cards include connectors for microphone 11 and speaker 12

The digital voice samples from unit 13 are then transmitted to an acoustic processor 15 which analyzes the digital samples. More specifically, the acoustic processor looks at a frequency versus time relationship (spectrograph) of the digital samples to extract a number of user-specific and non-user-specific characteristics or qualities of User A. Examples of non-user-specific qualities are age, sex, ethnic origin, etc. of User A. Such can be determined by storing a plurality of templates indicative of these qualities in a memory 14 associated with the acoustic processor 15. For example, samples can be taken from a number of men and women to determine an empirical range of values for the spectrograph of a male speaker or a female speaker. These samples are then stored in memory 14. An important user-specific quality is the identity of User A based on the spectrograph described above. Again, for this purpose a table of spectrograph patterns for known uses can be stored in the associated memory 14 which can be accessed by the acoustic processor 15 to find a match. Voice recognition based on a spectrograph pattern is known in the art.

The digital voice samples and the associated information on User A qualities is sent to a phonetic encoder 17 which takes this data and converts it to acoustic speech segments, such as phonemes. All speech patterns can be divided into a finite number of vowel and consonant utterances (typically what are referred to in the art as acoustic phonemes). The phonetic encoder 17 accesses a dictionary 18 of these phonemes stored in memory 14 and analyzes the digital samples from the voice capture device 13 to create a string of phonemes or utterances stored in its dictionary. In an embodiment of the present invention, the available phonemes in the dictionary can be stored in a table such that a value (e.g., an 8 bit value) is assigned to each phoneme. Such phoneme analysis can be found in many of today's voice recognition technology as well as voice compression/decompression devices (e.g., cellular phones, video conferencing applications, and packet-switched radios).

The speech segments need not be phonemes. The speech dictionary (i.e., phoneme dictionary) stored in memory 14 can comprise a digitized pattern (i.e., a phoneme pattern) and a corresponding segment ID (i.e., a phoneme ID) for each of a plurality of speech segments, which can be syllables, diphones, words, etc., instead of phonemes. However, it is advantageous, although not required, for the dictionary used in the present invention to use phonemes because there are only 40 phonemes in American English, including 24 consonants and 16 vowels, according to the International Phoneme Association. Phonemes are the smallest segments of sound that can be distinguished by their contrast within words. Examples of phonemes include /b/, as in bat, /d/, as in dad, and /k/ as in key or coo. Phonemes are abstract units that form the basis for transcribing a language unambiguously. Thus, although embodiments of the present invention are explained in terms of phonemes (i.e., phoneme patterns, phoneme dictionaries), the present invention may alternatively be implemented using other types of speech segments (diphones, words, syllables, etc.), speech patterns and speech dictionaries (i.e., syllable dictionaries, word dictionaries).

The digitized phoneme patterns stored in the phoneme dictionary in memory 14 can be the actual digitized waveforms of the phonemes. Alternatively, each of the stored phoneme patterns in the dictionary may be a simplified or processed representation of the digitized phoneme waveforms, for example, by processing the digitized phoneme to remove any unnecessary information. Each of the phoneme IDs stored in the dictionary is a multi bit word (e.g., a byte) that uniquely identifies each phoneme.

The phoneme patterns stored for all 40 phonemes in the dictionary are together known as a voice font. As noted above, voice font can be stored in memory 14 by a person saying into a microphone a standard sentence that contains all 40 phonemes, digitizing, separating and storing the digitized phonemes as digitized phoneme patterns in memory 14. System 40 then assigns a standard phoneme ID for each phoneme pattern.

The stream of utterances or sequential digital speech segments, (i.e., the table values for the string) is transmitted by the phonetic encoder 17 to a phonetic decoder 21 of User B over a transmission medium such as POTS (plain old telephone service) telephone lines through the use of modems 20 and 22. Alternatively, transmission may be over a computer network such as the Internet, using any medium enabling computer-to-computer communications. Examples of suitable communications media include a local area network (LAN), such as a token ring or Fast Ethernet LAN, an Internet or intranet network, a POTS connection, a wireless connection and a satellite connection. Embodiments of the present invention are not dependent upon any particular medium for communication, the sole criterion being the ability to carry user preference information and related data in some form from one computer to another.

Furthermore, although disclosed as being for transmission from one computer to another, it would also be possible to play the voice back through the same computer, either at the same time or at a later time by recording the data either in analog or digital form. Also, it is noted that phonetic encoding can precede the acoustic processing.

According to the illustrated embodiment of the present invention, User A can select a "voice transformation font" for his or her voice. In other words, User A can design the playback characteristics of his/her voice. Examples of such modifiable characteristics include timbre, pitch, timing, resonance, and/or voice personality elements such as gender. The selected transformation voice font (or an identification of the selected voice font) 19 is transmitted to User B in much the same manner as the stream of utterances e.g., via modems 20 and 22. Preferably, the stream of utterances and selected transformation voice font are transmitted as an encoded voice signal for playback. If desired, the phonetic dictionary 18 can also be transferred to User B, but such is not necessary if the entries in the phonetic dictionary are separately stored and accessible by the phonetic decoder 21 through a memory 24 associated with decoder 21.

User B has in its system, in addition to phonetic decoder 21 and memory 24, an acoustic processor 23 and a voice playback unit 25. Memory 24 is also coupled to acoustic processor 23 and voice playback 25. The same voice fonts as are stored in memory 14 can also be stored in memory 24. In such a case it is only necessary to transmit an identification of the selected transformation font from User A to User B. Phonetic decoder 21 accesses the phonetic dictionary which contains entries for converting the stream of utterances from the phonetic encoder 17 into a second stream of utterances for output to User B in the selected transformation font. The second stream of utterances is sent by the phonetic encoder to second acoustic processor 23 along with a digital signal representative of the user-specific and/or non-user-specific information obtained by the acoustic processor 15. The second acoustic processor 23 can extract the user information and presents that data to User B. In a case where user A's identity is to be concealed, only non-user specific information will usually be provided to user data output 29. However, the user's specific data may be transmitted to a third party 30 for security purposes. The second stream of utterances is then converted into a digital representation of the output audio signal for User B which, in turn, is converted into an analog audio output signal by the voice playback component 25. The analog audio signal is then played through an analog sound reproduction device such as a speaker 27.

As an example, if User A is a Caucasian male with a German accent, he may select to convert his voice into a woman's voice having no accent. After User A speaks into the microphone 11, the analog voice input data is converted into digital data by the voice capture component 13 and sent to the acoustic processor 15. The acoustic processor 15 analyzes the frequency versus time relationship of User A's voice to determine that User A is a male with an ethnic background of German (non-user-specific information). The acoustic processor 15 also compares the frequency versus time relationship of User A's voice with one or more templates of known voices to determine the identity of User A (user-specific information). After the digital voice data is converted into a stream of utterances by the phonetic encoder 17, it is sent to the phonetic decoder 21 of User B where it is converted into a second stream of utterances having a female voice and no accent based on the transformation font sent by User A. The new voice pattern is sent to the second acoustic processor 23 where it is converted for output by the voice playback component 25 for User B. If desired, some or all of the user information obtained by the acoustic processor 15 can be output to User B (i.e., letting User B know that User A is a male with a German accent) via an output device 29 such as a screen or printer. Of course, if desired, User A's full identity may be provided). Accordingly, with this information User B can know if he/she is talking to a male or female.

If a conversation is to take place in both directions, each of the users will, of course, have a voice capture and voice playback unit, typically combined, for example, in a sound card. Similarly, both will have acoustic processors capable of encoding and decoding and both will have a phonetic encoder and phonetic decoder. This is indicated in each of the units by the items in parenthesis.

Figure 2:
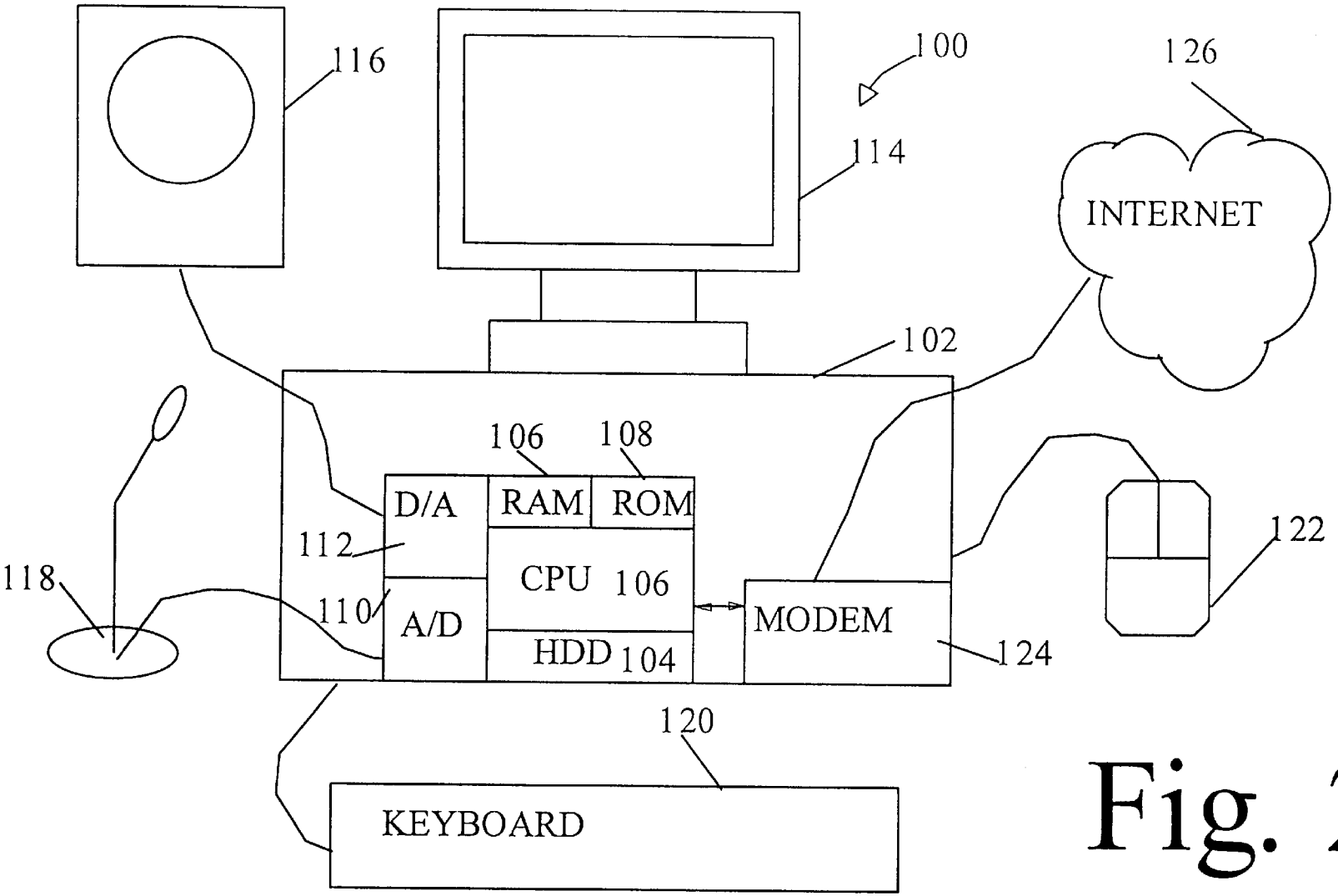
FIG. 2 illustrates, in block diagram form, a personal computer including an embodiment of a system according to the present invention.

FIG. 2 illustrates a block diagram of an embodiment of a computer system for implementing embodiments of the speech encoding system and speech decoding system of the present invention. Personal computer system 100 includes a computer chassis 102 housing the internal processing and storage components, including a hard disk drive (IDD) 104 for storing software and other information, a CPU 106 coupled to HDD 104, such as a Pentium processor manufactured by Intel Corporation, for executing software and controlling overall operation of computer system 100. A random access memory (RAM) 136, a read only memory (ROM) 108, an A/D converter 110 and a D/A converter 112 are also coupled to CPU 106. As noted above, the D/A and A/D converters may be incorporated in a commercially available sound card. Computer system 100 also includes several additional components coupled to CPU 106, including a monitor 114 for displaying text and graphics, a speaker 116 for outputting audio, a microphone 118 for inputting speech or other audio, a keyboard 120 and a mouse 122. Computer system 100 also includes a modem 124 for communicating with one or more other computers via the Internet 126. Alternatively, direct telephone communication is possible as are the other types of communication discussed above. HDD 104 stores an operating system, such as Windows 95®, manufactured by Microsoft Corporation and one or more application programs. The phoneme dictionaries, fonts and other information (stored in memories 14 and 24 of FIG. 1) can be stored on HDD 104. By way of example, the functions of voice capture 13, voice playback 25, acoustic processors 15 and 23, phonetic encoder 17 and phonetic decoder 21 can be implemented through dedicated hardware (not shown in FIG. 2), through one or more software modules of an application program stored on HDD 104 and written in the C++ or other language and executed by CPU 106, or a combination of software and dedicated hardware.

The foregoing is a detailed description of particular embodiments of the present invention as defined in the claims set forth below. The invention embraces all alternatives, modifications and variations that fall within the letter and spirit of the claims, as well as all equivalents of the claimed subject matter.

What is claimed is:

1. A method of encoding an analog voice signal for playback in a form in which the identity of the voice is disguised comprising:

a. storing a plurality of voice fonts;

b. receiving the analog voice signal;

c. converting the analog voice signal to a first digital voice signal;

d. dividing the digital voice signal into a plurality of sequential speech segments, wherein each of said voice fonts corresponds to a different type of voice when combined with said plurality of speech segments;

e. selecting one of said stored voice fonts as a playback voice font;

f. generating as the encoded voice signal for playback said plurality of sequential speech segments and said selected font and an identification of said selected font;

g. transmitting said sequential speech segments and said selected voice font encoded voice signal for playback over a transmission medium from a first location;

h. analyzing the digital voice signal to identify characteristics of the voice signal and transmitting said characteristics of the voice signal over said medium;

i. receiving said sequential speech segments and said selected voice font for playback at a second location;

j. converting said encoded voice signal into a second digital voice signal by reassembling said speech segments with said selected voice font as the voice font of said second digital signal;

k. converting said second digital signal to a playback audio signal;

l. playing said audio signal; and m. displaying information concerning the characteristics of said voice at said second location.

2. The method of claim 1 and further including generating said analog voice signal.

3. The method according to claim 1 wherein said characteristics of said voice comprise characteristics not specific to the user.

4. The method according to claim 1 and further including receiving said characteristics of said voice at a third location.

5. The method according to claim 4 wherein said characteristics of said voice comprise characteristics specific to the user.

6. The method according to claim 1 wherein said step of storing a plurality of voice fonts comprises:

a. generating a plurality of analog voice signals each having different voice characteristics;

b. converting each analog voice signal to a first digital voice signal;

c. analyzing each of the first digital voice signals to identify characteristics of the voice signal; and d. storing said characteristics as the voice font for that voice.

7. Apparatus for encoding an analog voice signal for playback in a form in which the identity of the voice is disguised comprising:

an analog to digital converter having an input for receiving an analog voice signal and providing a first digital voice signal output;

an acoustic processor and encoder coupled to receive said first digital signal providing as a first output a stream of digital speech segments and as a second output a digital signal representative of the voice characteristics of the voice signal;

a memory storing a plurality of voice fonts, each of said voice fonts corresponding to a different type of voice when combined with said plurality of speech segments;

an input device coupled to said memory and adapted to select one of said stored voice fonts as a playback voice font;

a transmitting device transmitting said stream of speech segments for playback over a transmission medium from a first location, said transmitting device also transmitting the selected one of said voice fonts; and an output device coupled to said decoder to receive said characteristics of said voice at said second location;

wherein said characteristics of said voice comprise characteristics not specific to the user.

8. Apparatus according to claim 7 and further including a microphone generating said analog voice signal.

9. Apparatus according to claim 7 wherein said transmission device comprises a modem.

10. Apparatus according to claim 9 wherein said transmission medium comprises the Internet.

11. Apparatus according to claim 7 wherein said transmission device also outputs data representative of said characteristics of the voice signal.

12. Apparatus according to claim 7 and further including:

a. a device receiving said stream of speech segments and said selected voice font;

b. a decoder and acoustic processor converting said stream of speech segments and selected voice font by reassembling said speech segments with said selected voice font as the voice font of said second digital signal;

c. a digital to analog converter coupled to receive said second digital signal as an input and providing a playback audio signal as an output; and d. a sound reproduction device coupled to the output of said digital to analog converter.

13. A personal computer comprising:

a processor;

an analog to digital and digital to analog converter each having an input and an output;

a microphone adapted to receive an audio voice signal as an input and having an output coupled to said input of said analog to digital converter;

an acoustic processor and encoder having an input coupled to the output of said analog to digital converter and having as a first output a stream of digital speech segments and as a second output a digital signal representative of the voice characteristics of the voice signal;

a memory storing a plurality of voice fonts, each of said voice fonts corresponding to a different type of voice when combined with said plurality of speech segments;

an input device coupled to said memory and adapted to select one of said stored voice fonts as a playback voice font;

a modem having an input coupled to receive said stream of digital speech segments and said selected font and an output adapted to be coupled to a transmission medium, a decoder and acoustic processor coupled to said modem and adapted to receive a further stream of digital speech segments obtained from a second analog voice signal and a further voice font for playback, transmitted from a remote location and providing as an output a second digital voice signal which includes said further speech segments reassembled with said further selected voice font as the voice font of said second digital signal;

a digital to analog converter having an input and an output, said input coupled to receive said second digital signal and providing a playback audio signal at its output;

a sound reproduction device coupled to the output of said digital to analog converter; and an output device coupled to said decoder to receive said characteristics of said second voice signal and providing said characteristics as an output;

wherein said characteristics of said second voice signal comprise characteristics not specific to the user.

14. A personal computer according to claim 13 wherein said digital to analog converter and said analog to digital converter are contained in a sound card.

15. A personal computer according to claim 13 wherein said acoustic processor encoder, and said decoder and acoustic processor, comprise software modules stored in said memory and executed by said processor.

* * * * *

UNITED STATES PATENT AND TRADEMARK OFFICE

CERTIFICATE OF CORRECTION

PATENT NO. : 5,911,129
DATED : June 8, 1999
INVENTOR(S) : Timothy N. Towell

It is certified that error appears in the above-identified patent and that said Letters Patent is hereby corrected as shown below:

| | |
|---|---|
| Column 3, line 33 | "In other the words" should be --In other words-- |
| Column 3, line 44 | "speaker **12**" should be --speaker **12**.-- |
| Column 6, line 25 | "(IDD) **104**" should be --(HDD) **104**-- |
| Column 6, line 27 | "Pentium processor" should be --Pentium® processor-- |
| Column 6, line 43 | "discussed above. HDD **104**" should be --discussed above. HDD **104**-- |

Signed and Sealed this

Twenty-third Day of May, 2000

*Attest:*

Q. TODD DICKINSON

*Attesting Officer*

*Director of Patents and Trademarks*